US006897187B2

(12) United States Patent
Gallotti et al.

(10) Patent No.: US 6,897,187 B2
(45) Date of Patent: May 24, 2005

(54) LIGHT DUTY LIQUID CLEANERS COMPRISING A MONOALKOXYLATED QUATERNARY AMMONIUM SURFACTANT

(75) Inventors: Manlio Gallotti, Sao Paulo (BR); George R. Nunez, Santos (BR)

(73) Assignee: Clariant International Ltd., Muttenz (CH)

( * ) Notice: Subject to any disclaimer, the term of this patent is extended or adjusted under 35 U.S.C. 154(b) by 0 days.

(21) Appl. No.: 10/276,209

(22) PCT Filed: May 11, 2001

(86) PCT No.: PCT/EP01/05420

§ 371 (c)(1),
(2), (4) Date: Jun. 5, 2003

(87) PCT Pub. No.: WO01/88073

PCT Pub. Date: Nov. 22, 2001

(65) Prior Publication Data

US 2004/0023832 A1 Feb. 5, 2004

(30) Foreign Application Priority Data

May 16, 2000 (EP) ..... 00110420

(51) Int. Cl.[7] ..... C11D 1/62; C11D 1/86

(52) U.S. Cl. ..... 510/237; 510/235; 510/237; 510/421; 510/422; 510/424; 510/425; 510/426; 510/427; 510/504

(58) Field of Search ..... 510/235, 237, 510/421, 422, 424, 425, 426, 427, 504

(56) References Cited

U.S. PATENT DOCUMENTS

| | | | | |
|---|---|---|---|---|
| 3,929,678 A | | 12/1975 | Laughlin et al. | 252/526 |
| 4,919,839 A | | 4/1990 | Durbut et al. | 252/153 |
| 5,230,823 A | * | 7/1993 | Wise et al. | 510/235 |
| 5,415,812 A | * | 5/1995 | Durbut et al. | 510/365 |
| 5,441,541 A | | 8/1995 | Mehreteab et al. | 8/137 |
| 5,668,100 A | | 9/1997 | Schmid et al. | 510/446 |
| 5,929,024 A | * | 7/1999 | Stringer et al. | 510/504 |

FOREIGN PATENT DOCUMENTS

| | | | |
|---|---|---|---|
| DE | 2648304 | * | 5/1977 |
| DE | 26 48 304 | | 5/1977 |
| DE | 198 00 392 | | 7/1999 |
| EP | 0 121 949 | | 10/1984 |
| EP | 1 162 254 | | 12/2001 |
| GB | 1 336 556 | | 11/1973 |
| GB | 1336556 | * | 12/1975 |
| GB | 2 303 141 | | 2/1997 |
| GB | 2 323 375 | | 9/1998 |
| WO | WO 95/08616 | | 3/1995 |
| WO | WO 95/29218 | | 11/1995 |
| WO | 97/43388 | * | 11/1997 |
| WO | WO 97/43388 | | 11/1997 |
| WO | WO 98/17759 | | 4/1998 |
| WO | WO 98/17777 | | 4/1998 |
| WO | WO 98/20092 | | 5/1998 |
| WO | WO 00/32727 | | 6/2000 |

OTHER PUBLICATIONS

English abstract for DE 2648304, May 5, 1977.
English abstract for DE 19800392, Jul. 15, 1999.
Table of Contents and Title page for "Surface Active Agents and Detergents", vol. I and II, Schwartz, Perry and Berch, 1958.

* cited by examiner

*Primary Examiner*—Charles Boyer
(74) *Attorney, Agent, or Firm*—Richard P. Silverman

(57) ABSTRACT

The present invention relates to a clear liquid detergent composition suitable for use in dishwashing and multipurpose cleaners for household applications as well as for industrial and institutional uses. The clear liquid detergent comprises a) 1 to 40 percent an anionic surfactant or group of anionic surfactants, b) 0.01 to 10 percent cationic surfactants, and c) optionally, 0.05 to 15 percent amphoteric and/or nonionic surfactants. More particularly, the light duty detergents of the present invention cationic compounds of the formula:

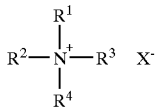

wherein $R^1$ is $C_8$–$C_{22}$-alkyl, $C_8$–$C_{22}$-alkenyl, $C_8$–$C_{22}$-alkyl/alkenylamidopropyl, $C_8$–$C_{22}$ alkoxyalkenylethyl, $C_8$–$C_{22}$-alkyl/alkenyi(poly)alkoxyalkyl, $C_8$–$C_{22}$-alkanoylethyl or $C_8$–$C_{22}$-alkenoylethyl, $R^2$ is $C_1$–$C_{22}$-alkyl, Cl—$C_{22}$-alkenyl or a group of the formula —A—$(OA)_n$—OH, $R^3$ and $R^4$ are $C_1$–$C_{22}$-alkyl, $C_2$–$C_{21}$-alkenyl or a group of the formula —A—$(OA)_n$—OH, A is —$C_2H_4$— and/or —$C_3H_6$— and n is a number from 0 to 20 and X is an anion.

6 Claims, No Drawings

LIGHT DUTY LIQUID CLEANERS COMPRISING A MONOALKOXYLATED QUATERNARY AMMONIUM SURFACTANT

The invention relates to "light duty liquid" (LDL) cleaners, in particular manual dishwashing detergents, household cleaners and also its institutional & industrial applications.

Modern household cleaners and dishwashing detergents must satisfy high requirements: they must have good detergency toward soiling and grease, good foam stabilization, good appearance, appropriated viscosity and also be environmentally compatible.

Increasing skin incompatibilities and allergic reactions require the development of new surfactants/surfactant mixtures and/or the use of alternative substances, in particular for cleaners which are used daily and come into contact with the skin. To minimize transportation, storage and packaging costs, and also to improve handling for the consumer, modern cleaners and dishwashing detergents having high concentrations of detersive substances are available commercially. However, highly concentrated preparations require the use of solvents and/or hydrotropes which bring the diverse constituents into solution, effect a clear and homogeneous formulation with suitable viscosities, and are also said to avoid gel formation during the preparation or storage of the composition. Usually used for this purpose are non-surface-active organic solvents, such as ethanol, glycol, polyglycols or solubilizers, for example alkylbenzenesulfonates having low chain lengths, such as, for example, toluene- or xylenesulfonate. It is desirable to dispense with compounds which exhibit little or no detersive ability.

On the other hand, lowly concentrated preparations are very hard to thicken and usually require the use of big amounts of thickeners increasing the cost of final product and don't aiding in detergency.

It has now been found out that the use of quaternary ammonium compounds in light duty liquid formulations provides a sensitive synergic improvement in physical and chemical properties of the mixture, such as detergency increment and better viscosity adjustment.

About non-gel formulations, the use of quaternary ammonium compounds allows organic solvents, such as ethanol or glycols, and hydrotropes to be dispensed or to be significantly reduced, but nevertheless allows a favorable viscosity adjustment (100 cps to 1000 cps) to be achieved. Furthermore, there is no danger here of gel formation upon prolonged storage as a result of slow evaporation of the solubilizer.

In case of gel formulations, the addition of quaternary ammonium compounds allows thickeners (ex. electrolytes) to be significantly reduced or even dispensed since the anionic/cationic association provides a viscosity increment. That effect is important because it reduces danger of formulations become clouded due the use of smaller amounts of electrolytes.

The invention provides light duty liquid cleaners, in particular manual dishwashing detergents and household cleaners, comprising water, anionic surfactants, optionally nonionic and/or amphoteric surfactants, and cationic compounds of the formula

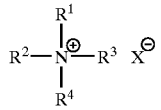

wherein $R^1$ is $C_8$–$C_{22}$-alkyl, $C_8$–$C_{22}$-alkenyl, $C_8$–$C_{22}$-alkylamidopropyl, $C_8$–$C_{22}$-alkenyl-amidopropyl, $C_8$–$C_{22}$-alkyl/alkenyl(poly)alkoxyalkyl, $C_8$–$C_{22}$-alkanoylethyl or $C_8$–$C_{22}$-alkenoylethyl, $R^2$, $R^3$ and $R^4$ are $C_1$–$C_{22}$-alkyl, $C_1$–$C_{22}$-alkenyl or a group of the formula —A—$(OA)_n$—OH, A is —$C_2H_4$— and/or —$C_3H_6$—, n is a number from 0 to 20 and X is an anion.

Preferred anionic surfactants are linear alkylbenzene sulfonates, olefinsulfonates, alkyl ether sulfates and sec. Alkanesulfonates and its associations.

The preferred alkylbenzenesulfonates contain linear chains having from 9 to 25 carbon atoms, preferably from 10 to 13 carbon atoms, the cation is sodium, potassium, ammonium, mono-, di- or triethanolammonium, calcium or magnesium and mixtures thereof. The alkyl group can either be saturated or unsaturated, branched or linear and optionally substituted by a hydroxyl group.

The olefinsulfonates also may contain 9 to 25, preferably 10 to 13 carbon atoms, the cation being the same as for the alkylbenzene sulfonates.

The alkyl ether sulfates used in the compositions according to the invention are water-soluble salts or acids of the formula $RO(A)_mSO_3M$, in which R is an unsubstituted $C_{10}$–$C_{24}$-alkyl or $C_{10}$–$C_{24}$-hydroxyalkyl radical, preferably a $C_{12}$–$C_{20}$-alkyl or $C_{12}$–$C_{20}$-hydroxyalkyl radical, particularly preferably $C_{12}$–$C_{18}$-alkyl or $C_{12}C$ –$C_{18}$-hydroxyalkyl radical. "A" is an ethoxy or propoxy unit, m is a number greater than 0, preferably between 0.5 and about 6, particularly preferably between about 0.5 and about 3, and M is a hydrogen atom or a cation, such as, for example, a metal cation (e.g. sodium, potassium, lithium, calcium magnesium, etc.), ammonium or a substituted ammonium cations. Specific examples of substituted ammonium cations are methylammonium, dimethylammonium, trimethylammonium, mono-, di- or triethanolammonium and quaternary ammonium cations, such as tetramethylammonium and dimethylpiperidinium cations, and also those derived from alkylamines, such as ethylamine, diethylamine, triethylamine. Examples of these alkyl ether sulfates which may be mentioned are $C_{12}$–$C_{18}$-alkylpolyethoxylate (1.0) sulfate, ($C_{12}$–$C_{18}$-E(1.0)M), $C_{12}$–$C_{14}$-alky polyethoxylate (2.0) sulfate ($C_{12}$–$C_{14}$-E(2.0)M), $C_{12}$–$C_{18}$-alkyl polyethoxylate (2.25) sulfate ($C_{12}$–$C_{18}$-E(2.25)M), $C_{12}$–$C_{18}$-alkyl polyethoxylate (3.0) sulfate, ($C_{12}$-$C_{18}$-E(3.0)M), $C_{12}$–$C_{18}$-alkyl polyethoxylate (4.0) sulfate ($C_{12}$–$C_{18}$-E(4.0)M).

In the case of the secondary alkanesulfonates, the alkyl group can either be saturated or unsaturated, branched or linear, and optionally substituted by a hydroxyl group. The sulfo group is distributed randomly over the entire carbon chain, where the primary methyl groups on the start of the chain and on the end of the chain do not have sulfonate groups. Preferred secondary alkanesulfonates contain linear alkyl chains having from 9 to 25 carbon atoms, preferably from 10 to 20 carbon atoms and particularly preferably from 13 to 17 carbon atoms. The cation is sodium, potassium, ammonium, mono-, di- or triethanolammonium, calcium or magnesium and mixtures thereof. For the sake of simplicity, sodium is preferred as cation.

In addition to or instead of these preferred anionic surfactants, the LDL formulations according to the invention can also comprise other types of anionic surfactants within the limits given above, such as, for example, alkylsulfates, -carboxylates, -phosphates and mixtures of said compounds. Suitable cations are, for example, sodium, potassium, calcium or magnesium, and also ammonium, substituted ammonium compounds, including mono-, di- or triethanolammonium cations, and also mixtures of these cations. The anionic surfactants which are suitable for the present invention have surfactant properties and are water-soluble or water-dispersible.

Alkylsulfates are water-soluble salts or acids of the formula $ROSO_3M$, in which R is preferably a $C_{10}$–$C_{24}$-hydrocarbon radical, preferably an alkyl or hydroxyalkyl radical having $C_{10}$–$C_{20}$-alkyl components, particularly preferably a $C_{12}$–$C_{18}$-alkyl or hydroxyalkyl radical. M is hydrogen or a cation, e.g. sodium, potassium, lithium or ammonium or substituted ammonium, e.g. methyl-, dimethyl- and trimethylammonium cations and quaternary ammonium cations, such as tetramethylammonium and dimethylpiperidinium cations and quaternary ammonium cations derived from alkylamines, such as ethylamine, diethylamine, triethylamine and mixtures thereof. Instead of alkylsulfates also the corresponding alkenylsulfates may be used or sulfates with mixed alkyl/alkenyl groups.

Other suitable anionic surfactants are carboxylates, e.g. fatty acid soaps and comparable surfactants. These soaps can be saturated or unsaturated and can contain various substituents, such as hydroxyl groups or alpha-sulfonate groups.

Preference is given to linear saturated or unsaturated hydrocarbon radicals as hydrophobic component in the soaps. Usually, the hydrophobic components contain from 6 to 30 carbon atoms, preferably from 10 to 18 carbon atoms. Other anionic surfactants are salts of acylaminocarboxylic acids, which are formed by reaction of fatty acid chlorides with sodium sarcosinate in alkaline medium (acyl sarcosinates) and also fatty acid protein condensation products, which are obtained by reaction of fatty acid chlorides with oligopeptides. The salts of alkylsulfamidocarboxylic acids and the salts of alkyl and alkylaryl ether carboxylic acids also have surfactant character.

Other anionic surfactants which are useful for use in detergents and cleaners are sulfonated polycarboxylic acids prepared by sulfonation of the pyrrolysis products of alkaline earth metal citrates, as described, for example, in GB 1 082 179, alkyl glycerol sulfates, fatty acyl glycerol sulfates,-oleyl glycerol sulfates, alkylphenol ether sulfates, primary paraffinsulfonates, alkylphosphates, alkyl ether phosphates, isethionates, such as acylisethionates, N-acyltaurides, alkylsuccinamates, sulfosuccinates, monoesters of the sulfosuccinates (particularly saturated and unsaturated $C_{12}$–$C_{18}$-monoesters) and diesters of sulfosuccinates (particularly saturated and unsaturated $C_{12}$–$C_{18}$-diesters), acylsarcosinates, sulfates of alkylpolysaccharides such as sulfates of alkylglycosides, branched primary alkylsulfates and alkylpolyethoxycarboxylates, such as those of the formula $RO(CH_2CH_2)_kCH_2COO^-M^+$ in which R is a $C_8$–$C_{22}$-alkyl, k is a number from 0 to 10 and M is a cation which forms a soluble salt. Resin acids or hydrogenated resin acids, such as rosin or hydrogenated rosin or tall oil resins and tall oil resin acids can likewise be used. Other examples are described in "Surface Active Agents and Detergents" (Vol. I and 11, Schwartz, Perry and Berch). A large number of such surfactants are also described in U.S. Pat. No. 3,929,678.

Typical examples of anionic surfactants are also alkyl ether sulfonates, glycerol ether sulfonates, sulfofatty acids, fatty alcohol ether sulfates, glycerol ether sulfates, hydroxylmixed ether sulfate, fatty acid amide (ether) sulfates, mono- and dialkylsulfosuccinates, mono- and dialkylsulfosuccinamates, sulfotriglycerides, amide soaps, alkyloligoglucosidesulfates, alkylamino sugar sulfates and alkyl (ether) phosphates. If the anionic surfactants contain polyglycol ether chains, they can have a conventional or else a narrowed homologue distribution.

The amount of anionic surfactant or mixture of anionic surfactants in the claimed compositions is from 1 to 40, preferentially from 3 to 20% by weight.

As cationic surfactants there may be used the following ones, alkyldimethyl-hydroxyethyl-ammonium, alkyldimethyl(poly)alkoxyalkyl-ammonium, alkyltrimethylammonium, dialkyldimethyl-ammonium, dialkyl-methyl (poly)alkoxyalkyl-ammonium, alkyl-di(poly)-alkoxyalkylmethyl-ammonium, dialkyl-di(poly)alkoxy-ammonium, alkyl-tri(poly)-alkoxy-ammonium, alkylamidopropyltrimethyl-ammonium, alkylamidopropyl-dimethyl(poly)alkoxyalkyl-ammonium, alkoxyethyl-trimethyl-ammonium. Instead of alkyl these ammonium compounds may also have alkenyl groups or mixtures of both. The alkyl as well as the alkenyl groups may contain 8 to 22 carbon atoms. They may be linear or branched. (Poly)alkoxyalkyl means a group of the formula $—A—(OA)_n—OH$ wherein A is ethylen or propylene group or a mixture of both and n is a number of from 0 to 20. Preferably n is zero and A is ethylene that means those compounds and preferred which contain a hydroxyethyl group. Most preferred ammonium compounds are $C_8$–$C_{22}$-alkyl- or alkenyl-dimethyl-hydroxyethylammonium compounds. All mentioned ammonium compounds may contain any kind of anion, the preferred ones are chloride, bromide, acetate, lactate, sulphate or methosulphate.

The claimed compositions may contain these ammonium compounds in an amount from 0.01 to 10, preferably from 0.02 to 5% by weight.

Furthermore, the compositions according to the invention may contain 0.05 to 15, preferably 0.1 to 10% by weight of nonionic and/or amphoteric surfactants. The nonionic or amphoteric surfactants may be alkyl polyalkylene glycol, alkylaryl-polyalkylene glycol, alkyldimethyl amine oxide, di-alkyl methyl amine oxide, alkylamidopropyl amine oxide, alkyl glucamides, alkyl polyglycosides, oxalkylated fatty acids, oxalkylated fatty acid esters, alkyl amines, oxalkylated alkyl amines, alkyl amidopropyl betaines, alkyl dimethyl betaines, alkyl amphoacetates or -diacetates. The alkyl groups of these compounds, which may be partially or fully replaced by alkenyl groups, may contain 8 to 22 carbon atoms and may be linear or branched. The polyalkylene glycol groups may contain 1 to 20 ethoxy and/or propoxy units.

Depending on the intended use, the formulations according to the invention comprise, in addition to said surfactants and water, additives and auxiliaries which are customary and specific in each case, for example builders, salts, solubilizers, enzymes, thickeners, preservatives, fragrances and dyes, pearlizing agents, emulsifiers and sequestering agents.

Suitable organic and inorganic builders are neutral or, in particular, alkaline salts which are able to precipitate out calcium ions or bind calcium ions to form a complex. Suitable and particularly ecologically acceptable builder substances, such as finely crystalline, synthetic hydrous zeolites preferably the type NaA, which have a calcium-binding capacity in the range from 100 to 200 mg of CaO/g, are used in preference. Zeolite and phyllosilicates can be present in the composition in an amount up to 20% by weight. Organic builders which can be used are, for example, the percarboxylic acids preferably used in the form of their sodium salts, such as citric acid and nitriloacetate (NTA), ethylenediaminetetraacetic acid, provided such a use is not objectionable for ecological reasons. Analogous thereto, it is also possible to use polymeric carboxylates and salts thereof. These include, for example, the salts of homopolymeric or copolymeric polyacrylates, polymethylacrylates and in particular, copolymers of acrylic acid with maleic acid, and also polyvinylpyrrolidone and urethanes. The relative molecular mass of the homopolymers is generally between 1000 and 100,000, that of the copolymers is between 2000 and 200,000, preferably 50,000 to 120,000, based on the free acid, in particular water-soluble polyacrylates which have been crosslinked, for example, with approximately 1% of a sugar polyallyl ether and which have a relative molecular mass above one million are also suitable. Examples thereof are the polymers obtainable under the name Carbopol® 940 and 941. The crosslinked polyacrylates are used in amounts not exceeding 1% by weight, preferably in amounts of from 0.2 to 0.7% by weight. The builder substances can be used in amounts up to 5% by weight.

The desired viscosity of the compositions is adjusted by adding water and/or organic solvents, or by adding a combination of organic solvents and thickeners.

In principle, suitable organic solvents are any mono- or polyhydric alcohols. Preference is given to using alcohols having from 1 to 4 carbon atoms, such as methanol, ethanol, propanol, isopropanol, straight-chain and branched butanol, glycerol and mixtures of said alcohols. Other preferred alcohols are polyethylene glycols having a relative molecular mass below 2000. In particular, the use of polyethylene glycol having a relative molecular mass between 200 and 600 and in amounts up to 45% by weight, and of polyethylene glycol having a relative molecular mass between 400 and 600 in amounts from 5 to 25% by weight is preferred. Also the lower alkyl ether of ethyleneglycol, propyleneglycol, polyethylenglykol and polypropylenglykol can be used. An advantageous mixture of solvents consists of a monomeric alcohol, for example ethanol and polyethylene glycol in the ratio 0.5:1 to 1.2:1.

Other suitable solvents are, for example, triacetin (glycerol triacetate) and 1-methoxy-2-propanol.

Preferred thickeners are hydrogenated castor oil, salts of long-chain fatty acids, which are preferably used in amounts of from 0 to 5% by weight and in particular in amounts from 0.5 to 2% by weight, for example sodium, potassium, aluminum, magnesium and titanium stearates or the sodium and/or potassium salts of behenic acid, and polysaccharides, in particular xanthan gum, guar guar, agar agar, alginates and tyloses, carboxymethylcellulose and hydroxyethylcellulose, and also relatively high molecular weight polyethylene glycol mono- and -diesters of fatty acids, polyacrylates, polyvinyl alcohol and polyvinylpyrrolidone, and also electrolytes such as sodium chloride and ammonium chloride Suitable enzymes are those from the class of proteases, lipases, amylases and their mixture. Their proportion can be from 0.2 to 1% by weight. The enzymes can be adsorbed to carrier substances and/or embedded into coating substances.

Suitable preservatives are, for example, phenoxyethanol, formaldehyde solution, pentanediol or sorbic acid.

Suitable pearlizing agents are, for example, glycerol distearic esters such as ethylene glycol distearate, but also fatty acid monoglycol esters.

Suitable salts or extenders are, for example, sodium sulfate, sodium carbonate, ammonium chloride, magnesium chloride, sodium chloride, sodium tripolyphosphate, sodium silicate (water glass) or magnesium sulfate.

Typical individual examples of other additives are sodium borate, starch, sucrose, polydextrose, RAED, stilbene compounds, methylcellulose, toluenesulfonate, cumenesulfonate, soaps and silicones.

The products according to the invention are notable for very good storage stability and also detergency.

The examples below serve to illustrate the invention in more detail without limiting it thereto.

EXAMPLES

I) Liquid Dishwashing Detergent % (w/w)
A) 4.7 Linear alkyl benzene sulfonic acid (96% a.m.)
B) 21.8 Sodium laureth 2 sulphate (27% a.m.) (Genapol LRO®)
C) 6.6 Cocoamidopropylbetaine (30% a.m.) (Genagen CAB®)
D) 1.2 $C_{12}/C_{14}$-Alkyl dimethyl hydroxyethyl ammonium chloride (40% a.m.) (Praepagen HY®)
E) 6.1 NaOH (sol. 10% w/w)
F) Water qsp 100
G) Perfume qs
H) Colorant qs
I) Preservant qs
Procedure
I. Mix at room temperature A+E+F
II. Add B & C and mix
III. Add D and mix
IV. Add G, H & I and mix II) Liquid Dishwashing Detergent % (w/w)
A) 1.9 Sec-alkane sulphonate (60% a.m.) (Hostapur SAS®)
B) 8.1 Sodium laureth 2 sulphate (27% a.m.) (Genapol LRO®)
C) 2.1 Cocoamidopropylbetaine (30% a.m.) (Genagen CAB®)
D) 1.2 $C_{12}/C_{14}$-Alkyl dimethyl hydroxyethyl ammonium chloride (40% a.m.) (Praepagen HY®)
E) Water qsp 100
F) Perfume qs
G) Colorant qs
H) Preservant qs
Procedure
I. Mix at room temperature A+E
II. Add B & C and mix
III. Add D and mix
IV. Add F, G & H and mix III) Liquid Dishwashing Detergent % (w/w)
A) 12.5 Sec-alkane sulphonate (60% a.m.) (Hostapur SAS®)
B) 70.1 Sodium laureth 2 sulphate (27% a.m.) (Genapol LRO®)
C) 8.3 $C_{12}/C_{14}$-Alkyl dimethyl hydroxyethyl ammonium chloride (40% a.m.) (Praepagen HY®)
D) Water qsp 100
E) Perfume qs
F) Colorant qs
G) Preservant qs
Procedure
I. Mix at room temperature A+D
II. Add B and mix
III. Add C and mix
IV. Add E, F & G and mix

What is claimed is:

1. A light duty liquid cleaner consisting of a) water;

b) from 1 to 40% by weight of an anionic surfactant;

c) from 0.01 to 10% by weight of a cationic compound of the formula

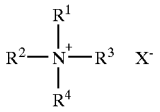

wherein $R^1$ is selected from the group consisting of $C_8$–$C_{22}$-alkyl, $C_8$–$C_{22}$-alkenyl, $C_8$–$C_{22}$-alkyl/alkenylamidopropyl, $C_8$–$C_{22}$alkoxyalkenylethyl, $C_8$–$C_{22}$-alkyl/alkenyi(poly)alkoxyalkyl, $C_8$–$C_{22}$-alkanoylethyl, $C_8$–$C_{22}$-alkenoylethyl, and mixtures thereof, $R^2$ is a group of the formula —A—$(OA)_n$—OH, $R^3$ and $R^4$ are selected from the group consisting of $C_1$–$C_{22}$-alkyl, $C_2$–$C_{21}$-alkenyl, or mixtures thereof.

A is —$C_2H_4$— and/or —$C_3H_6$— and n is a number from 0 to 20 and

X is an anion;

d) from 0.05 to 15% by weight of a non-ionic surfactant and/or an amphoteric surfactant;

e) at least one additive or auxiliary selected from the group consisting of builders, salts, solubilizers, solvents, enzymes, thickeners, preservatives, fragrances, dyes, pearlizing agents, emulsifiers, sequestering agents, and mixtures thereof, wherein said thickeners are selected from the group consisting of hydrogenated castor oil, salts of long-chain fatty acids, polysaccharides, carboxymethylcellulose, hydrocellulose, polyethylene glycol mono- and di esters of fatty acids, poly acrylates, polyvinyl alcohol, polyvinylpyrolidone, electrolytes, and mixtures thereof; and wherein in said light duty cleaner glycols are dispensed with.

2. A light duty liquid cleaner as claimed in claim 1, wherein the anionic surfactant is selected from the group consisting of alkylbenzene sulfonates, olefinsulfonates, alkyl sulfates, alkyl ether sulfates, sec. Alkanesulfonates, and mixtures thereof.

3. A light duty liquid cleaner as claimed in claim 1, wherein the cationic compound is an $C_8$–$C_{22}$-alkyl- or $C_8$–$C_{22}$-alkenyl-dimethyl-hydroxy-ethyl ammonium compound.

4. A light duty liquid cleaner as claimed in claim 1, wherein the anionic surfactant is present in an amount of from 3 to 20% by weight.

5. A light duty liquid cleaner as claimed in claim 1, wherein the cationic compound is present in an amount of from 0.02 to 5% by weight.

6. A process for washing dishes comprising contacting the dishes with the light duty liquid cleaner of claim 1.

* * * * *

UNITED STATES PATENT AND TRADEMARK OFFICE

CERTIFICATE OF CORRECTION

PATENT NO. : 6,897,187 B2
APPLICATION NO. : 10/276209
DATED : May 24, 2005
INVENTOR(S) : Manilo Gallotti and George R. Nunes It is certified that error appears in the above-identified patent and that said Letters Patent is hereby corrected as shown below:

On the Title page, item [75], change the Inventor(s) from "Manilo Gallotti; George R. Nunes" to -- Manilo Gallotti; George I. P. Nunes --.

Signed and Sealed this

Twenty-second Day of May, 2007

JON W. DUDAS
*Director of the United States Patent and Trademark Office*